US010663173B2

(12) United States Patent
Yeo

(10) Patent No.: US 10,663,173 B2
(45) Date of Patent: May 26, 2020

(54) ELECTRIC COOKING APPLIANCE

(71) Applicant: LG ELECTRONICS INC., Seoul (KR)

(72) Inventor: Taehong Yeo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 556 days.

(21) Appl. No.: 15/394,294

(22) Filed: Dec. 29, 2016

(65) Prior Publication Data

US 2018/0045420 A1 Feb. 15, 2018

(30) Foreign Application Priority Data

Aug. 10, 2016 (KR) ..... 10-2016-0101706

(51) Int. Cl.
*F24C 7/00* (2006.01)
*H05B 6/64* (2006.01)

(52) U.S. Cl.
CPC ..... *F24C 7/00* (2013.01); *H05B 6/6414* (2013.01); *H05B 6/6426* (2013.01)

(58) Field of Classification Search
CPC ..... F24C 7/00; H05B 6/6414; H05B 6/6426
USPC ..... 219/202, 267, 400, 402; 174/48, 50, 53, 174/60, 66, 67, 480, 535, 541, 559, 653
See application file for complete search history.

(56) References Cited

U.S. PATENT DOCUMENTS 5,486,650 A * 1/1996 Yetter ..... H02G 3/10 174/53
2012/0316605 A1* 12/2012 Palagi ..... A61B 17/7037 606/305
2016/0097541 A1 4/2016 Choi

FOREIGN PATENT DOCUMENTS

| | | | |
|---|---|---|---|
| CN | 2382195 | | 6/2000 |
| CN | 1467421 | | 4/2004 |
| CN | 2732144 | | 10/2005 |
| CN | 201950491 | | 8/2011 |
| CN | 20465985 | | 9/2015 |
| CN | 205072704 | | 3/2016 |
| CN | 205101568 | | 3/2016 |
| DE | 43 0 4525 | | 8/1994 |
| EP | 2 333 426 | | 6/2011 |
| EP | 2333426 | * | 6/2011 |
| JP | S 61-012578 | | 1/1986 |
| KR | 10-2003-0074005 | | 9/2003 |

(Continued)

OTHER PUBLICATIONS

European Search Report dated Nov. 3, 2017 issued in Application No. 17151382.3.

(Continued)

*Primary Examiner* — Phuong T Nguyen
(74) *Attorney, Agent, or Firm* — Ked & Associates, LLP

(57) ABSTRACT

A structure covering a connection line, an electric cooking appliance including the same, and a method of assembling a cap of the electric cooking appliance includes a base plate including a through hole in a vertical direction, a cap provided below the base plate and provided with an accommodation space formed therein to accommodate a connection line placed through the through hole from an upper portion of the base plate, a coupling boss extending in a vertical direction in the cap and coupled to bottom of the base plate to couple the cap to the base plate, and a fastener inserted through the base plate from the upper portion of the base plate to couple the base plate to the coupling boss.

8 Claims, 10 Drawing Sheets

(56) References Cited

FOREIGN PATENT DOCUMENTS

| | | |
|---|---|---|
| KR | 20-0368567 | 11/2004 |
| KR | 10-2005-0005018 | 1/2005 |

OTHER PUBLICATIONS

Korean Office Action dated Dec. 7, 2017 issued in Application No. 10-2016-0101706.
Chinese Office Action dated Mar. 4, 2020 issued in CN Application No. 201710025968.3.

* cited by examiner

ELECTRIC COOKING APPLIANCE

CROSS-REFERENCE TO RELATED APPLICATIONS

This application claims the priority under 35 U.S.C. § 119 to Korean Application No. 10-2016-0101706 filed on Aug. 10, 2016, whose entire disclosure is herein incorporated by reference.

BACKGROUND

1. Field

The present disclosure relates to a structure for covering a connection line, an electric cooking appliance including the same, and a method of assembling a cap of the electric cooking appliance, and more particularly, to a structure for covering a connection line, an electric cooking appliance including the same, and a method of assembling a cap of the electric cooking appliance, for covering a connection line used to connect a main body of a device and a control panel.

2. Background

Thus far, various types of apparatuses have been proposed to heat food. A primitive heating apparatus may be a container directly in contact with a heat source, in which content to be cooked is placed and heated.

Many types of cooking apparatuses that directly or indirectly use electric energy have been developed, and an example of a cooking apparatus may include a microwave oven using microwave as a heater. A microwave oven may generate microwaves using electricity and infiltrate the microwaves into a cooking object accommodated in a cooking chamber to heat by causing a molecular motion in the cooking object.

The microwave oven may irradiate a high frequency of magnetron to a cooking object and simultaneously heat internal and external parts of the cooking object. The microwave oven has been widely used due to advantages that a cooking time of food is remarkably reduced due to high thermal efficiency, loss in a nutritional value may be reduced during cooking, thawing, and heating procedures of food, and food is capable of being cooked while being contained in a container.

In general, such a microwave oven may include a door to open and close a cooking chamber formed in a main body. Examples of the door included in the microwave oven may include a right and left opening door, an up and down opening door, a sliding door, and so on according to an opening type. The most commonly used method is the right and left opening door.

A control panel may be provided on a front surface of a microwave oven. In general, the control panel may be installed in a main body so as to be positioned at a lateral portion of a door and include a plurality of functional keys related to control an operation of the microwave oven by a user.

Recently, microwave ovens have been formed by installing a separate functional portion using an extra space of a machine room corresponding to a portion of a control panel and a rear portion thereof and installing the control panel in a door. When a control panel is installed in a main body, a connection line between the main body and the control panel may be positioned in the main body so as not to be externally exposed.

However, when a control panel is installed in a door, a connection line connected to a main body needs to extend from the main body to be connected to the control panel and, thus, the connection line is inevitably and externally exposed at a connection portion between the main body and the door. In this regard, when the connection line is externally exposed, this provides an aesthetically unappealing sight and the connection line is in danger of being damaged.

As a method of overcoming this problem, a connection line may be prevented from being exposed by installing a separate cap on a portion through which a connection line is exposed and accommodating the connection line in the installed cap. In general, a predetermined space for accommodating a connection line exposed outside a main body may be provided in a cap and the cap may be installed by arranging the cap on a bottom surface of the main body and then coupling the cap to the bottom surface of the main body via a fastener such as a bolt.

However, when such a structure for installing the cap is used, the main body of the microwave oven may need to be reversibly positioned such that the bottom surface on which the cap is to be installed is directed upward during an operation of coupling the cap to the main body. Thus, there the operation may be difficult and working time may be increased.

BRIEF DESCRIPTION OF THE DRAWINGS

The embodiments will be described in detail with reference to the following drawings in which like reference numerals refer to like elements wherein.

DETAILED DESCRIPTION

Figure 1:
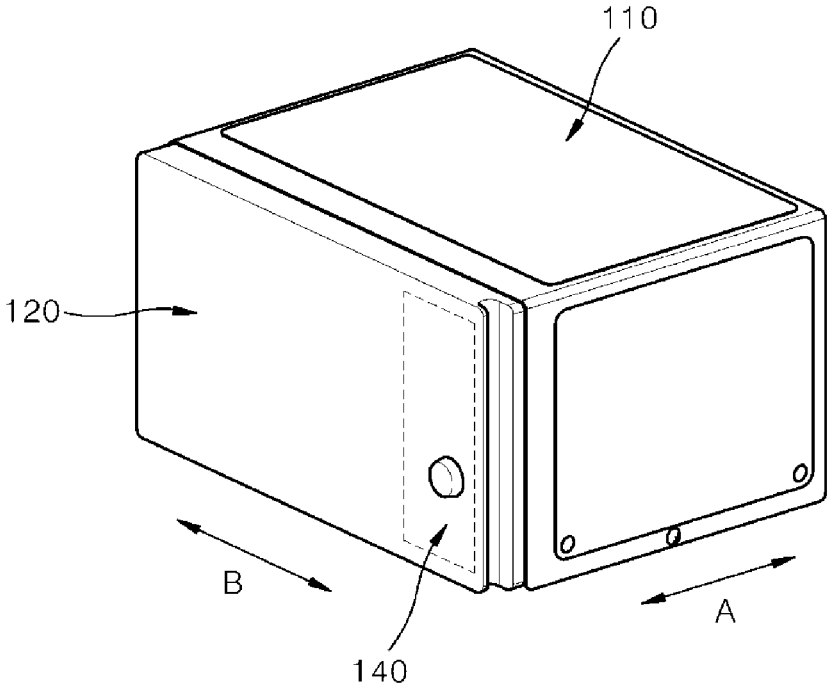
FIG. 1 is a schematic perspective view of an electric cooking appliance according to an exemplary embodiment of the present disclosure.

Hereinafter, a structure for covering a connection line, an electric cooking appliance including the same, and a method of assembling a cap of the electric appliance will be described with regard to exemplary embodiments of the invention with reference to the attached drawings. For convenience of description, the thicknesses of lines and the size of components in the drawings are exaggerated for clarity. The terms used in the specification are defined in consideration of functions used in the present disclosure, and can be changed according to intent or conventionally used methods of clients, operators, and users. Accordingly, definitions of the terms should be understood on the basis of the entire description of the present specification.

Figure 2:
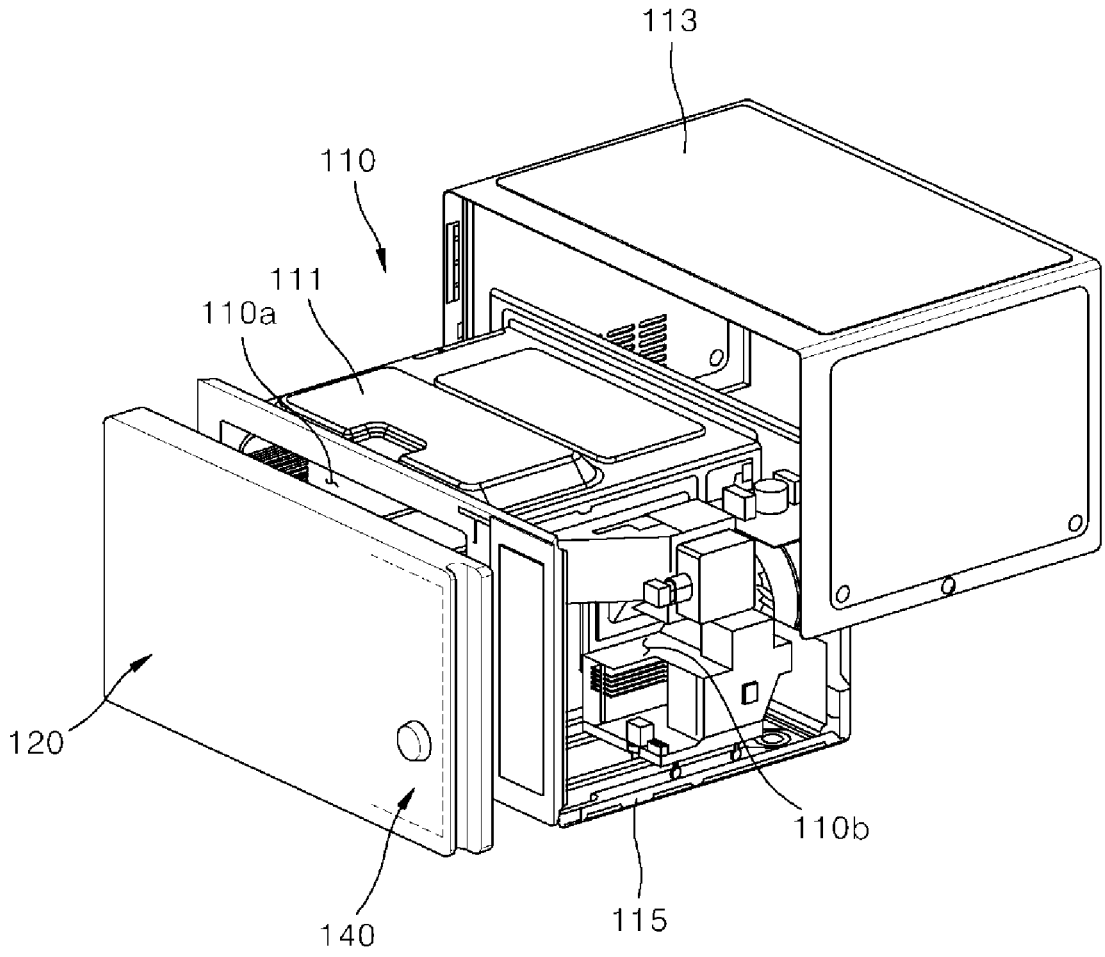
FIG. 2 is an exploded perspective view of a structure of an electric cooking appliance according to an exemplary embodiment of the present disclosure.

Referring to FIGS. 1 and 2, the electric cooking appliance according to an exemplary embodiment may include a main body 110 and a door 120. According to the present exemplary embodiment, a microwave oven irradiating a high frequency of a magnetron to a cooking object and simultaneously heating internal and external parts of the cooking object will be described as an example of an electric cooking appliance. However, the present disclosure is not limited thereto and various types of electric cooking appliances, such as an electric cooking appliance including an electric heater instead of a magnetron and an electric cooking appliance including both a magnetron and an electric heater may be included in the scope of the present disclosure.

The main body 110 may form an outer appearance of the electric cooking appliance and may be shaped like an approximate rectangular parallelepiped. The main body 110 may include a cavity 111, a case 113, and a base plate 115.

The cavity 111 may form a frame of the main body 110. The cavity 111 may include a cooking chamber 110*a* formed therein to accommodate an object to be cooked so as to be opened forward and a machine room 110*b* formed at a lateral side of the cooking chamber 110*a*. Electric components such as a magnetron and a high voltage transformer may be installed in the machine room 110*b*.

The case 113 may cover an external portion of the cavity 111, and may cover an upper portion and both lateral portions of the cavity 111 to form an outer appearance of the main body 110. The base plate 115 may be arranged on a lower surface of the cavity 111 to constitute the bottom surface of the main body 110.

The cooking chamber 110*a* may be formed with a front surface being opened in the main body 110 and may provide a space to accommodate food therein. The cooking chamber 110*a* may have a first lateral surface including an inlet through which outside air is introduced and a second lateral surface including an outlet through which the introduced air is externally discharged.

The door 120 may be provided at the opened front surface of the cooking chamber 110*a*. The door 120 may be installed at a front portion of the main body 110, or a front portion of the cooking chamber 110*a*. One side of the door 120 may be rotatably hinged on the main body 110.

A control panel 140 to set various cooking conditions and operate or suspending the electric cooking appliance may be provided at the front portion of the main body 110, in more detail, the front portion of the machine room 110*b*. The control panel 140 may include a button portion manipulated by a user and a display to display information on driving of the electric cooking appliance.

According to the present embodiment, the control panel 140 may be included in the door 120. The control panel 140 may be integrally installed with the door 120 so as to be rotated together with the door 120 when opening and closing the cooking chamber 110*a* rather than being installed in the main body 110.

The control panel 140 may include a manipulation panel and a substrate. The manipulation panel may be exposed through the front surface of the door 120 and may include a button and a display. The substrate may be installed in the door 120 so as not to be exposed through the front surface of the door 120 and may include various components to operate the button and display the manipulation panel.

The electric cooking appliance according to the present embodiment may include a connection line or cable 130 (refer to FIG. 4) between the aforementioned control panel 140 and the main body 110. A first side of the connection line 130 may be connected to the substrate of the control panel 140 in the door 120. In addition, a second side of the connection line 130 may be inserted into the main body 110 through the base plate 115 constituting the bottom surface of the main body 110 so as to be connected to a component such as a machine room substrate installed in the machine room 110*b*.

A through hole 115*a* may be formed in a vertical direction through the base plate 115 that is arranged below the cavity 111 to constitute the bottom surface of the main body 110. The connection line 130 may extend out of the main body 110 through the through hole 115*a* so as to connect components in the main body 110 and the substrate in the door 120.

Referring to FIGS. 3 to 8, the electric cooking appliance may further include a structure covering a connection line, including a cap 150, a coupling boss 160, and a fastener 190. The cap 150 may be provided below the base plate 115 and provided with an accommodation space formed therein to accommodate the connection line 130 passing through the through hole 115*a* above the base plate 115.

The cap 150 may function as a path for installing the connection line 130 and may also support the electric cooking appliance. A first portion of the connection line 130 extending from a lower portion of the base plate 115 through the through hole 115*a* may inevitably be exposed in a region between the main body 110 and the door 120 below the base plate 115.

The cap 150 may be installed at the region between the main body 110 and the door 120 below the base plate 115, where the first portion of the connection line 130 extends from the lower portion of the base plate 115. The cap 150 may accommodate the first portion of the connection line 130 extending from the lower portion of the base plate 115 in the region between the main body 110 and the door 120 below the base plate 115 to prevent the connection line 130 from being externally exposed.

For example, the cap 150 may be shaped like a box with an open upper portion. Accordingly, the cap 150 may include a bottom surface 151 that forms a flat surface spaced apart from the base plate 115 by a predetermined interval, and four lateral walls 153 extending in a vertical direction from the bottom surface 151.

The bottom surface 151 may be formed with a length in a forward and backward direction A, which extends to a portion of the door 120 where the connection line 130 is inserted or drawn out from a portion of the base plate 115, through which the through hole 115*a* is formed. According to the present embodiment, a direction in which front and rear surfaces of the electric cooking appliance are connected may be defined as the forward and backward direction A and a direction in which left and right lateral surfaces of the electric cooking appliance are connected may be defined as a right and left direction B.

The lateral wall 153 may extend upward along an edge of the bottom surface 151 and may have an appropriate height so as to form an accommodation space with a sufficient height to accommodate the connection line 130 in the cap 150. The lateral wall 153 may have a height as long as the cap 150 functions as a support of the electric cooking appliance.

The aforementioned cap 150 may be installed in such a way that a first side in the forward and backward direction A surrounds a lower region of the base plate 115 and a second side in the forward and backward direction A surrounds a lower region of the door 120. Thus, the connection line 130 may not be externally exposed in a region between the main body 110 and the door 120.

At least one of the four lateral walls 153 may be formed at a portion at which an upper end portion of the lateral wall 153 interferes with a lower surface of the base plate 115. An upper end portion of the lateral wall 153 provided below the base plate 115 among the lateral walls 153 may be formed at the portion that interferes with the lower surface of the base plate 115.

A position restriction structure restricting a movement in an upward direction of the cap 150 may be formed via interference between the lower surface of the base plate 115 and the lateral wall 153 so as to guide a position of the cap 150 in a vertical direction. The coupling boss 160 may be formed in the aforementioned cap 150. The coupling boss 160 may be shaped like a cylinder with a length extending in an upward direction from the bottom surface 151 of the cap 150 and, for example, may be integrally molded and formed with the cap 150.

The coupling boss 160 may be coupled to the base plate 115 and may allow the cap 150 to be coupled to the base plate 115 at a lower portion of the base plate 115. Coupling between the base plate 115 and the coupling boss 160 may be achieved by the fastener 190 to be described below.

A first coupling hole 115*c* may be formed through the base plate 115 in a vertical direction. A second coupling hole 160*a* may be formed in the coupling boss 160 so as to extend with a hollow shape in a vertical direction and may be open toward an upper portion of the coupling boss 160. As such, a screw thread accepting the fastener 190 to be described later may be formed in the coupling boss 160 in which the second coupling hole 160*a* is formed.

Accordingly, a coupling structure may be formed to couple the base plate 115 and the coupling boss 160 below the base plate 115 using the fastener 190. The first coupling hole 115*c* and the second coupling hole 160*a* may have a circular shape with a similar diameter and the cap 150 may be installed at a portion in which the first coupling hole 115*c* and the second coupling hole 160*a* overlap each other in a vertical direction.

In addition, a fit wall 115*b* formed by bending a surrounding portion of the first coupling hole 115*c* of the base plate 115 in an upward direction may be provided at the surrounding portion of the first coupling hole 115*c*. The fit wall 115*b* may taper upward such that a width of the first coupling hole 115*c* is reduced.

The coupling boss 160 may be fit-coupled to the fit wall 115*b* through the first coupling hole 115*c*. According to the fitting between the coupling boss 160 and the fit wall 115*b*, the cap 150 may be guided to be installed at a position in which the first coupling hole 115*c* and the second coupling hole 160*a* overlap each other in a vertical direction. By virtue of an inclination surface formed by the fit wall 115*b* that tapers upward such that the width of the first coupling hole 115*c* is reduced, a position for fitting the coupling boss 160 may be stably guided and fit-coupling between the coupling boss 160 and the fit wall 115*b* may be easily achieved.

The fastener 190 may be inserted through the base plate 115 from an upper portion of the base plate 115 so as to couple the base plate 115 and the coupling boss 160 to each other. The fastener 190 may include a screw configured in such a way that a body (or body) 191 is inserted into the first coupling hole 115*c* and the second coupling hole 160*a* from the upper portion of the base plate 115 and screwed to the coupling boss 160 and a head 193 is supported by the upper portion of the base plate 115.

The body 191 may be shaped like a cylinder including an outer circumferential surface with a screw thread formed thereon and formed through the base plate 115 via the first coupling hole 115*c* from the upper portion of the base plate 115. The head 193 may protrude from an upper end portion of the body 191 and may be supported by the upper portion of the base plate 115 so as to maintain a coupling state between the base plate 115 and the coupling boss 160 together with the body 191.

A structure for covering a connection line of an electric cooking appliance according to the present embodiment may further include a hook 170 and a guide rib 180. The hook 170 may be formed at the cap 150 and may protrude upward from the lateral wall 153. The hook 170 may include an elastic extension 171 and a hook protrusion 173.

The elastic extension 171 may be shaped like a plate extending upward from the lateral wall 153 and may be capable of elastically deforming in the right and left direction B. The elastic extension 171 may be positioned inside compared with the lateral wall 153 in the right and left direction B and may extend through the base plate 115 via the through hole 115*a*.

The elastic extension 171 may interfere with an inner circumferential surface of the through hole 115*a* when being inserted through the base plate 115 via the through hole 115*a*. According to interference between the elastic extension 171 and the inner circumferential surface of the through hole 115*a*, a position of one side of the cap 150 coupled to the base plate 115 may be guided in the right and left direction B The hook protrusion 173 may protrude from an upper end portion of the elastic extension 171. The hook protrusion 173 may interfere with an upper surface of the base plate 115 when positioned on the upper portion of the base plate 115. According to interference between the upper surface of the base plate 115 and the hook protrusion 173, a downward movement of the cap 150 coupled to the base plate 115 may be restricted.

The hook 170 including the elastic extension 171 and the hook protrusion 173 may interfere with the inner circumferential surface of the through hole 115*a* so as to guide a position of one side of the cap 150 coupled to the base plate 115 in the right and left direction B and interfere with the upper surface of the base plate 115 so as to restrict a downward movement of the cap 150 coupled to the base plate 115. The hook 170 may guide a position of the cap 150 coupled to the base plate 115 before the cap 150 is coupled to the fastener 190 and may primarily fix the cap 150 at the guided installation position.

The guide rib 180 may be formed on the cap 150 so as to protrude upward from the upper portion of the lateral wall 153. The guide rib 180 may extend through the base plate 115 via the through hole 115*a* and may contact the inner circumferential surface of the through hole 115*a* while extending through the base plate 115 via the through hole 115*a*.

According to the present embodiment, the hook 170 may include a wall surface with a width extending in the forward and backward direction A and the guide rib 180 may include a wall surface with a width extending in the right and left direction B. The hook 170 and the inner circumferential surface of the through hole 115*a* may contact each other in the right and left direction B, whereas the guide rib 180 and the inner circumferential surface of the through hole 115*a* may contact each other in the forward and backward direction A.

According to the contact between the guide rib 180 and the inner circumferential surface of the through hole 115*a*, a position of one side of the cap 150 coupled to the base plate 115 may be guided in the forward and backward direction A.

Figure 3:
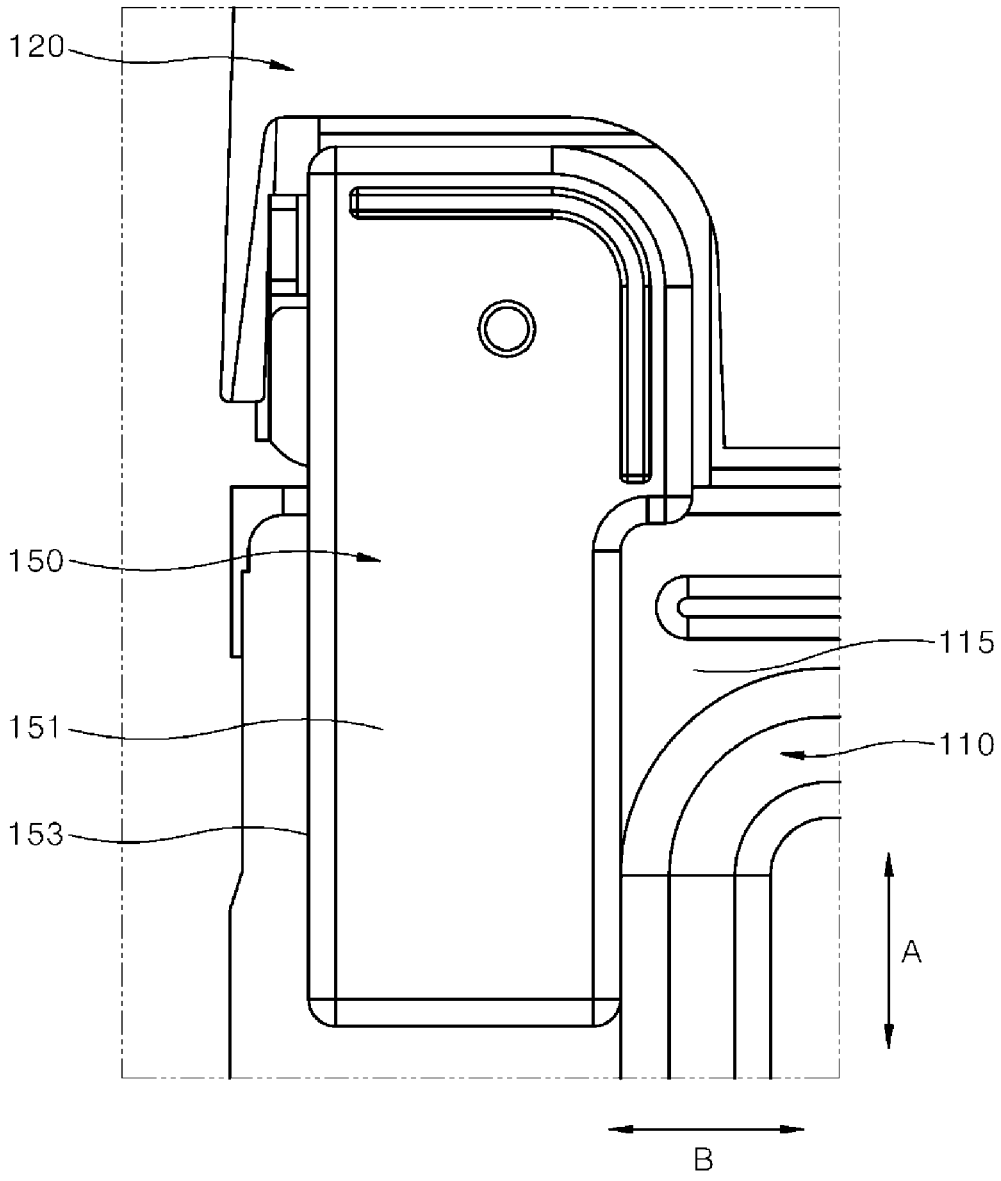
FIG. 3 is an enlarged bottom view of a portion of an electric cooking appliance according to an exemplary embodiment of the present disclosure.

Hereinafter, with reference to FIGS. 3 to 9, a method of assembling a cap of an electric cooking appliance and an operation and effect of an electric cooking appliance assembled with a cap using the method according to an exemplary embodiment of the present disclosure will be described. As illustrated in FIGS. 2 and 3, in order to assemble the cap 150 installed below the electric cooking appliance with a lower portion of the base plate 115, as illustrated in FIGS. 2 and 9, the door 120 may be rotatably coupled in front of the cavity 111 and the base plate 115 may be coupled to a lower portion of the cavity 111 (S10).

The control panel 140 may be located in the door 120 coupled in front of the main body 110. The control panel 140 may include a manipulation panel that is exposed through a front surface and a substrate that is installed in the door 120 so as not to be exposed through the front surface of the door 120.

The through hole 115*a* may be formed through the base plate 115 coupled to the lower portion of the cavity 111 in a vertical direction. The base plate 115 may be installed below the cavity 111 such that the through hole 115*a* is positioned adjacent to a front portion, or a portion in which the main body 110 and the door 120 are rotatably coupled to each other.

Figure 4:
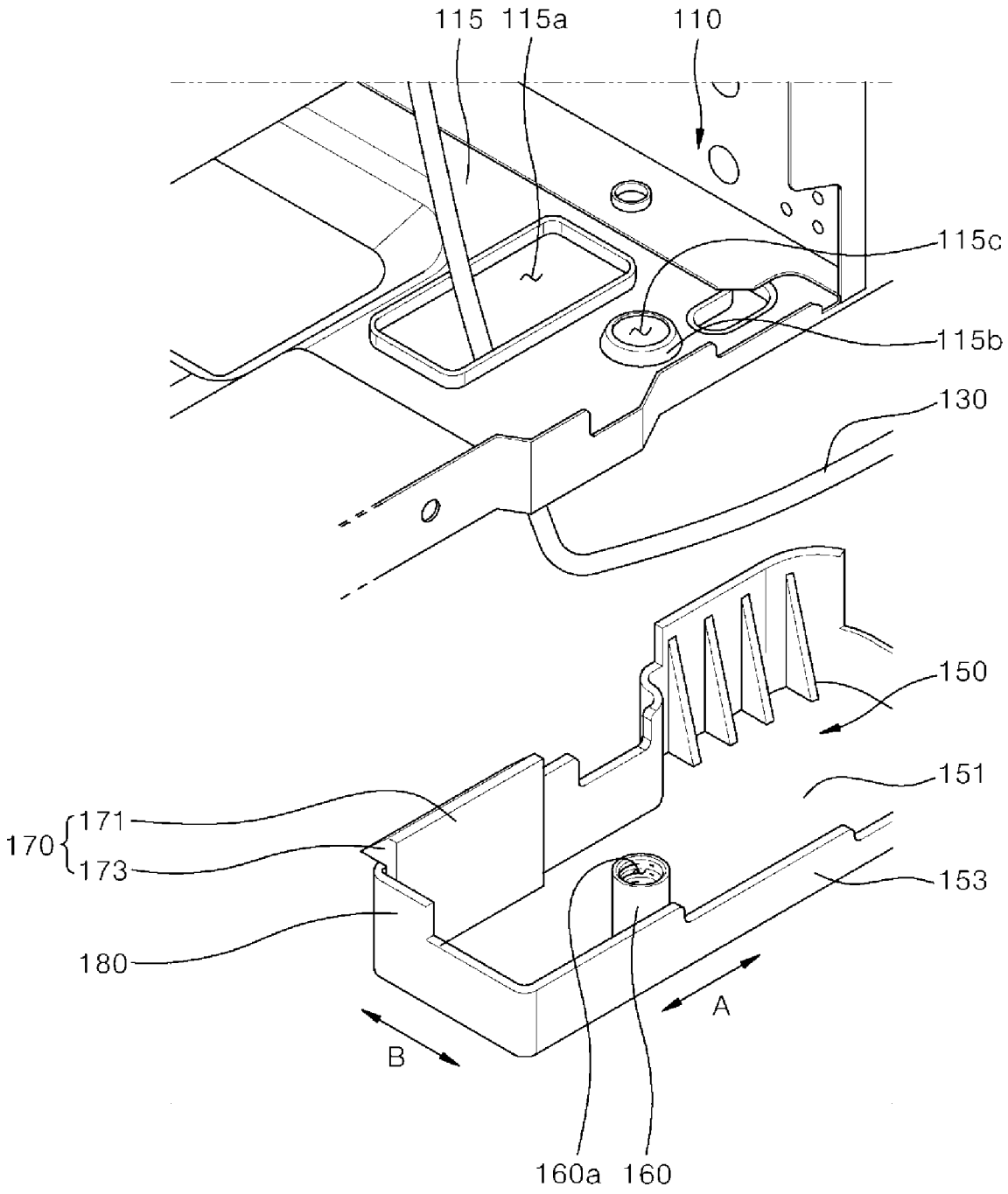
FIG. 4 is an exploded perspective view of a base plate and a cap according to an exemplary embodiment of the present disclosure.
Figure 9:
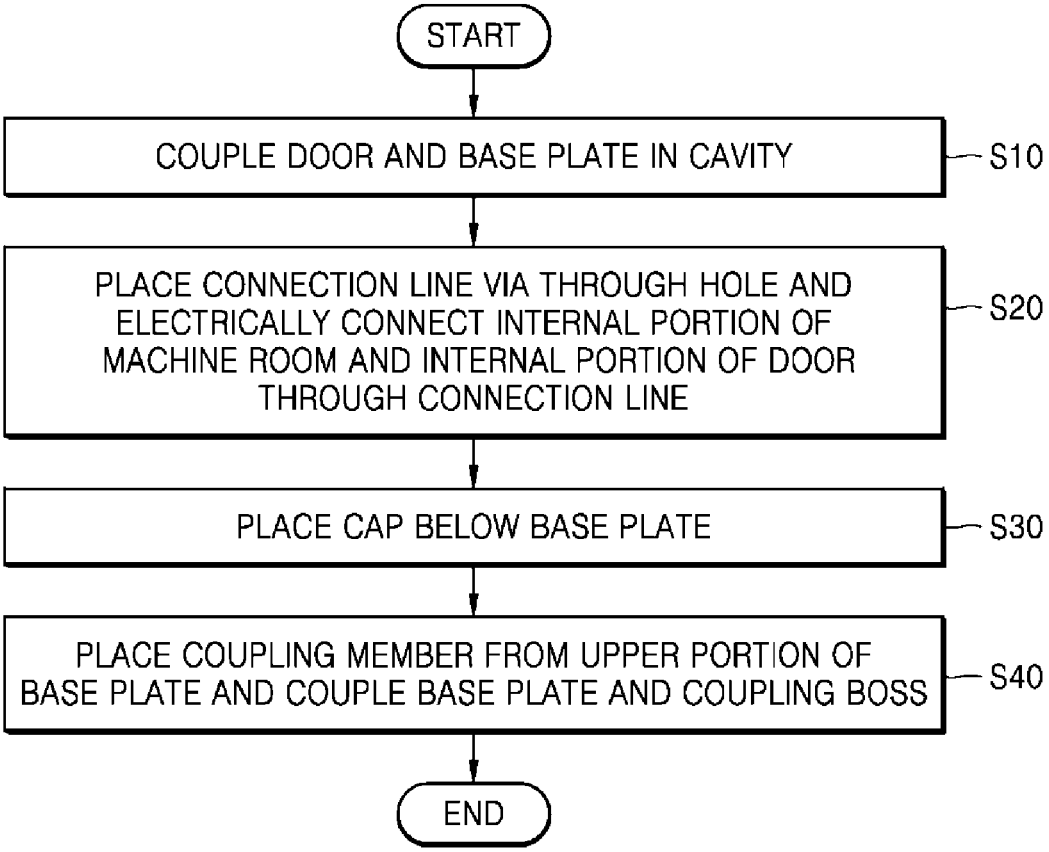
FIG. 9 is a flowchart illustrating a method of manufacturing an electric cooking appliance according to an exemplary embodiment of the present disclosure.

As illustrated in FIGS. 4 and 9, the connection line 130 may be placed through the through hole 115*a* and an internal portion of the machine room 110*b* and an internal portion of the door 120 may be electrically connected to each other through the connection line 130 (S20). Accordingly, the connection line 130 may be installed in such a way that a first side is connected to a substrate of the control panel 140 in the door 120 (refer to FIG. 3) and a second side is inserted into the r gain body 110 through the base plate 115 to be connected to a component such as a machine room substrate installed in the machine room 110*b*.

Figure 5:
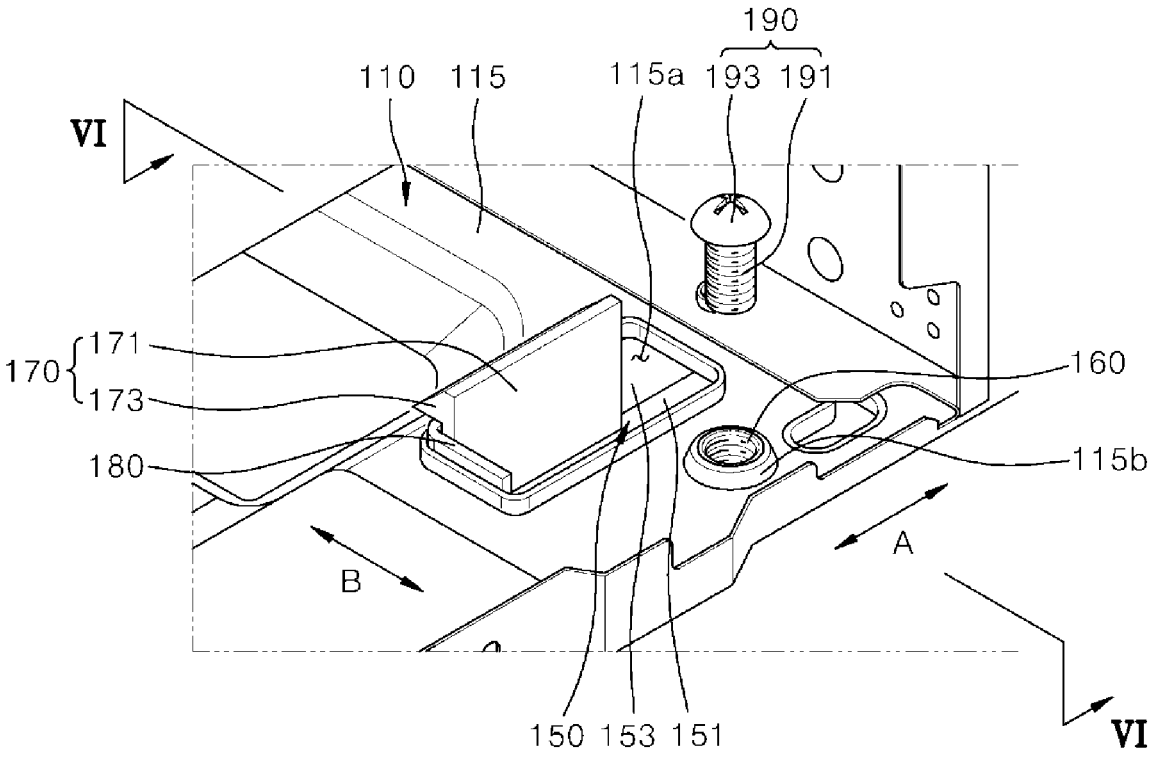
FIG. 5 is a perspective view illustrating a coupling state of a base plate and a cap according to an exemplary embodiment of the present disclosure.
Figure 6:
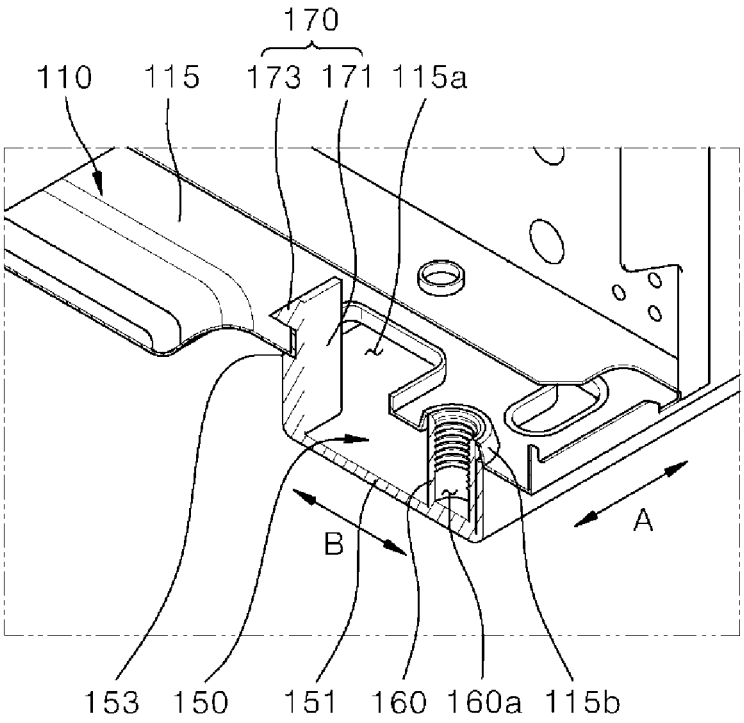
FIG. 6 is a cross-sectional view taken along a line "VI-VI" of FIG. 5.

In a region between the main body 110 and the door 120, which is deviated from the internal portion of the main body 110 and the internal portion of the door 120, a portion of the connection line 130 may be exposed out of the electric cooking appliance. As described above, when the connection line 130 is completely installed, the cap 150 may be positioned below the base plate 115 to fix the base plate 115 and the cap 150 so as to accommodate the externally exposed portion of the connection line 130 (refer to FIG. 4), or the portion of the connection line 130 exposed out of the electric cooking appliance, as illustrated in FIGS. 5, 6, and 9 (S30).

This procedure may be performed by inserting the hook 170 into the through hole 115*a* so as to allow the hook 170 provided in the cap 150 to latch with the inner circumferential surface of the through hole 115*a* and fit-couple the coupling boss 160 to the fit wall 115*b* provided in the base plate 115. Accordingly, the hook 170 and the inner circumferential surface of the through hole 115*a* may contact each other at a first side of the cap 150 in the right and left direction B and the coupling boss 160 and the fit wall 115*b* may be fit-coupled to each other at a second side of the cap 150 in the right and left direction B.

As such, according to interference between the hook 170 and the inner circumferential surface of the through hole 115*a* and the fit-coupling between the coupling boss 160 and the fit wall 115*b* at a first side and the second side of the cap 150 in the right and left direction B, a position of the cap 150 coupled to the base plate 115 may be guided in the right and left direction B. When the hook 170 is inserted into the through hole 115*a*, the guide rib 180 positioned adjacent to the hook 170 may also be inserted into the through hole 115*a* and, accordingly, the guide rib 180 and the inner circumferential surface of the through hole 115*a* may contact each other.

According to contact between the guide rib 180 and the inner circumferential surface of the through hole 115*a* and the fit-coupling between the coupling boss 160 and the fit wall 115*b*, a position of the cap 150 coupled to the base plate 115 may be guided in the forward and backward direction A. According to guidance of the positions of the cap 150 in the right and left direction B and the forward and backward direction A, the installation position of the cap 150 may be guided to a position in which the first coupling hole 115*c* (refer to FIG. 4) of the base plate 115 and the second coupling hole 160*a* (refer to FIG. 4) of the coupling boss 160 overlap each other in a vertical direction and the cap 150 may be primarily fixed at the guided installation position.

Accordingly, a position of the cap 150 may be primarily fixed at a position to couple the base plate 115 and the coupling boss 160 via the fastener 190 above the base plate 115 and subsequent coupling of the fastener 190 may be easily and stably performed. The hook 170 inserted into the through hole 115*a* as described above may contact the upper surface of the base plate 115 via the hook protrusion 173 so as to restrict a downward movement of the cap 150 coupled to the base plate 115.

The lateral wall 153 of the cap 150 and a lower surface of the base plate 115 may contact each other below the portion in which the hook 170 and the upper surface of the base plate 115 contact each other so as to restrict an upward movement of the cap 150. According to contact between the hook 170 and the upper surface of the base plate 115 and contact between the lateral wall 153 of the cap 150 and the lower surface of the base plate 115, the position of the cap 150 coupled to the base plate 115 may be guided and fixed in a vertical direction.

Figure 7:
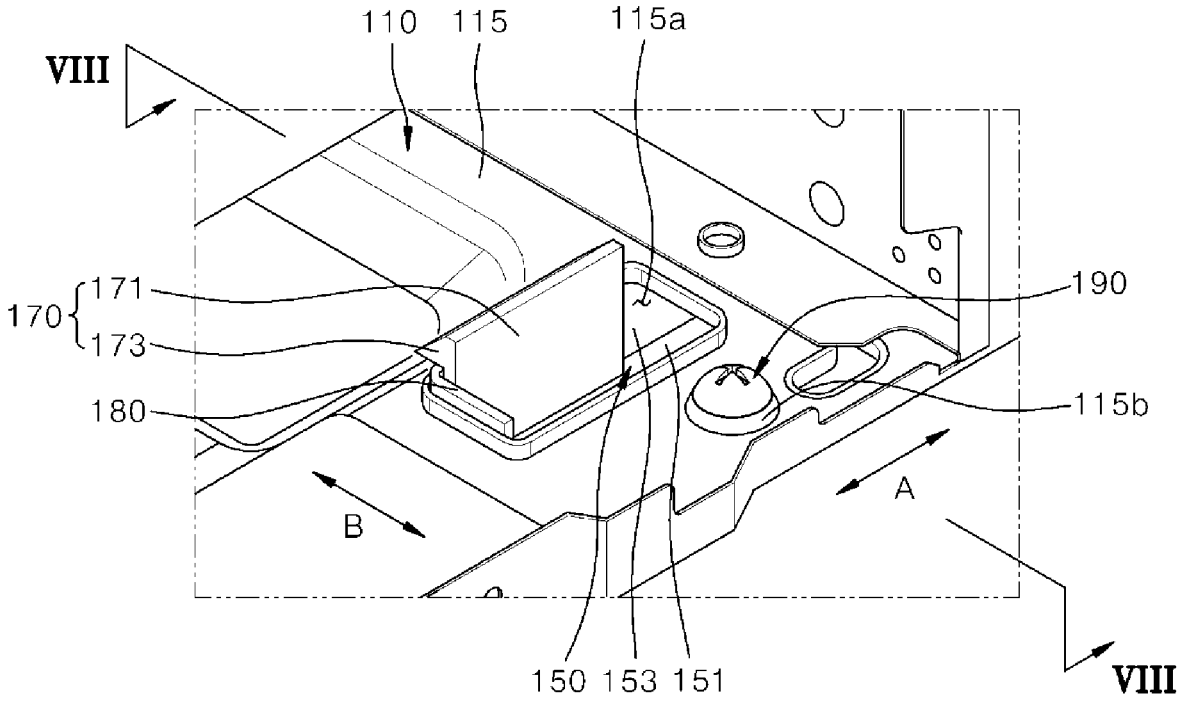
FIG. 7 is a perspective view of a completely assembled state of a cap according to an exemplary embodiment of the present disclosure.
Figure 8:
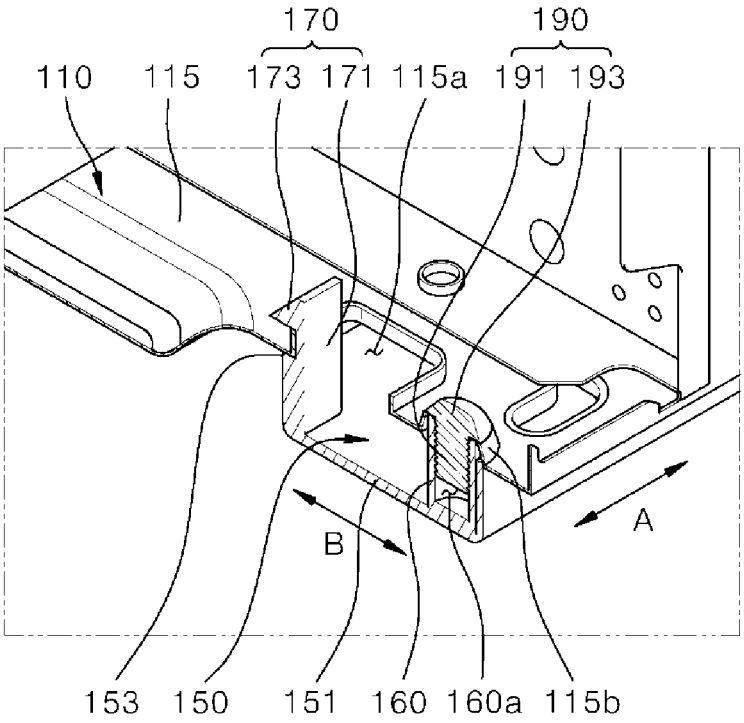
FIG. 8 is a cross-sectional view taken along a line "VIII-VIII" of FIG. 7.

As described above, when the position of the cap 150 is completely guided and fixed, the fastener 190 may be placed through the base plate 115 from the upper portion of the base plate, 115 and the base plate 115 and the coupling boss 160 may be coupled (S40) so as to completely assemble the cap 150, as illustrated in FIGS. 7 to 9. Conventionally, a main body of an electric cooking appliance may be reversibly positioned such that a bottom surface of the electric cooking appliance on which a cap is to be installed is directed upward. Then, the cap may be coupled to the main body of the electric cooking appliance by inserting into the main body while passing through the cap and the bottom surface of the main body from the outside of the main body.

Due to a position for installing the cap on the bottom surface of the main body, when the main body of the electric cooking appliance is not reversibly positioned, the installation position of the cap may not be accurately recognized and a space for coupling the screw is not ensured. However, when the main body of the electric cooking appliance is reversibly positioned in order to install the cap, the operation may be difficult and working time increased.

An operation of turning the reversibly positioned main body over to an original state after the cap is completely installed then needs to be further performed. Thus, a workload and working time may be increased, a product may be damaged while the main body is reversibly place, or there may be safety hazards such as operators' injuries.

Compared with the conventional case, according to the present embodiment, even if the main body 110 of the electric cooking appliance is not reversibly positioned, the structure covering a connection line so as to install the cap 150 may be provided. Accordingly, the fastener 190 may include a screw including the body 191 and the head 193 and the first coupling hole 115*c* and the second coupling hole 160*a* may be open upward in the base plate 115 and the coupling boss 160 in which the fastener 190 is inserted and coupled.

Accordingly, the fastener 190 may be inserted into the first coupling hole 115*c* and the second coupling hole 160*a* from the upper portion of the base plate 115 and coupled to the base plate 115 and the coupling boss 160. The coupling operation of the cap 150 may be performed when the main body 110 is right side up to direct the lower surface of the base plate 115 downward, but not in a state in which the main body 110 is upside down to direct the lower surface of the base plate 115 upward.

Without a difficult operation of turning over the main body 110, the cap 150 may be installed with a lower degree of difficulty while also reducing working time taken for the operation of installing the cap 150. In the aforementioned coupling structure, the portion of the fastener 190 placed through the main body 110 may be accommodated in the cap 150 in the coupling boss 160 so as not to be exposed out of the main body 110.

Accordingly, the fastener 190 used to install the cap 150 may be prevented from being externally exposed to degrade an overall appearance of the electric cooking appliance or damage a user. When the structure covering a connection line according to the present embodiment is used, the cap 150 may be guided to a targeted position to install the cap 150 simply by fitting the coupling boss 160 provided in the cap 150 to the fit wall 115*b* and inserting the hook 170 of the cap 150 into the through hole 115*a*. Thus, the cap 150 may be accurately placed at a targeted position even when the cap 150 is not accurately recognized by being hidden by the base plate 115.

When the position of the cap 150 is guided as described above, the cap 150 may be fixed at the corresponding position via hook coupling between the hook 170 and the base plate 115 and fit-coupling between the coupling boss 160 and the fit wall 115*b* at the guided position. As such, when the cap 150 is fixed, the operation of installing the cap 150 may be very easily and rapidly performed simply by coupling the fastener 190 to the upper portion of the base plate 115 without performing a subsequent operation of re-adjusting the cap 150 or fixing the cap 150 using a separate device or help of another operator.

When the structure covering a connection line, the electric cooking appliance including the same, and the method of assembling a cap of the electric cooking appliance are used, the cap 150 may be stably installed on the bottom surface of the main body 110 without a difficult operation of turning over the main body 110. Thus, degree of difficulty of the operation of installing the cap 150 may be lowered and working time taken to install the cap 150 may also be reduced.

When the structure covering a connection line, the electric cooking appliance including the same, and the method of assembling a cap of the electric cooking appliance according to the present invention are used, it may not be necessary to turn over the main body 110 in order to install the cap 150 on the bottom surface of the main body 110, thereby preventing a product being damaged or safety hazard such as operators' injuries from occurring while the main body is turned over. The cap 150 may be guided to a targeted position simply by fitting the coupling boss 160 provided in the cap 150 to the fit wall 115*b* and inserting the hook 170 of the cap 150 into the through hole 115*a*. The cap 150 may be fixed at the guided position, and thus, may enhance stability and convenience of the operation of installing the cap 150.

The aforementioned structure covering a connection line, the electric cooking appliance including the same, and the method of assembling a cap of the electric cooking appliance is merely an example of an exemplary embodiment of the present disclosure and there may be various embodiments for substituting the example. Hereinafter, another embodiment of the present disclosure will be described with reference to FIG. 10. The same reference numeral as in the above diagrams denotes the same member for the same function and, thus, a repeated description will be omitted here.

Figure 10:
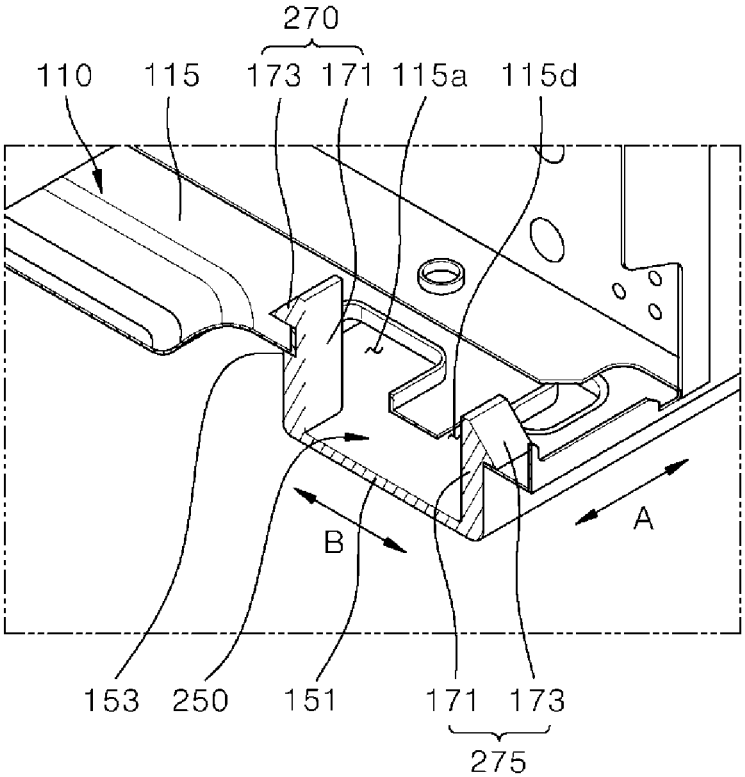
FIG. 10 is a cross-sectional view illustrating a state in which a cap of an electric cooking appliance is completely assembled according to another embodiment of the present disclosure.

Referring to FIG. 10, an electric cooking appliance according to another embodiment may include a structure covering a connection line, including a cap 250, a first hook 270, and a second hook 275. The cap 250 may include the bottom surface 151 and the lateral wall 153 like the cap 150 (refer to FIG. 4) according to the aforementioned embodiment.

The first hook 270 may include the elastic extension 171 and the hook protrusion 173 like in the hook 170 (refer to FIG. 4) according to the aforementioned embodiment and may be provided at a first side of the cap 250 in the right and left direction B. The first hook 270 may be inserted through the base plate 115 through the through hole 115*a* and hook-coupled to the base plate 115 to couple one side of the cap 250 to the base plate 115.

According to hook coupling between the first hook 270 and the base plate 115, a position of one side in the right and left direction B may be guided via contact between the first hook 270 and the inner circumferential surface of the through hole 115*a*. A position of the cap 250 in an upward direction may be guided and fixed via contact between the first hook 270 and the upper surface of the base plate 115 and contact between the lateral wall 153 of the cap 250 and the lower surface of the base plate 115.

The second hook 275 may include the elastic extension 171 and the hook protrusion 173 like the first hook 270 and may be provided at a second side of the cap 250 in the right and left direction B. The second hook 275 may be inserted through the base plate 115 at a different position from the first hook 270 and hook-coupled to the base plate 115 to couple the other side of the cap 250 to the base plate 115.

A hook hole 115*d* as a path for placing the second hook 275 through the base plate 115 may be formed through the base plate 115 separately from the through hole 115*a*. Accordingly, the second hook 275 may be inserted through the base plate 115 via the hook hole 115*d* and hook-coupled to the base plate 115 so as to couple the second side of the cap 250 to the base plate 115.

According to hook coupling between the second hook 275 and the base plate 115, a position of the second side of the cap 250 in the right and left direction B may be guided via contact between the second hook 275 and the inner circumferential surface of the hook hole 115*d*. A position of the cap 250 in an upward direction may be guided and fixed via contact between the second hook 275 and the upper surface of the base plate 115 and contact between the lateral wall 153 of the cap 250 and the lower surface of the base plate 115.

The through hole 115*a* may be formed in such a way that both the first hook 270 and the second hook 275 may be inserted through the base plate 115 via the through hole 115*a* without separately forming the hook hole 115*d* in the base plate 115. According to the aforementioned structure including the first hook 270 and the second hook 275, a primary fixing operation and a last coupling operation between the base plate 115 and the cap 250 may be performed at one time.

The coupling operation of the cap 250 may be completed at one time without an additional operation of coupling a screw simply by fit-coupling the first hook 270 and the second hook 275 to the base plate 115. Thus, the operation of installing the cap 250 may be more easily and rapidly performed.

The present disclosure described above may be variously substituted, altered, and modified by those skilled in the art to which the present disclosure pertains without departing from the scope and spirit of the present disclosure. Therefore, the present disclosure is not limited to the above-mentioned exemplary embodiments and the accompanying drawings.

It is an object of the present disclosure to provide a structure covering a connection line, an electric cooking appliance including the same, and a method of assembling a cap of the electric cooking appliance, for lowering degree of difficulty of an operation of installing a cap and reducing working time taken to the operation of installing the cap. It is another object of the present disclosure to provide a structure covering a connection line, an electric cooking appliance including the same, and a method of assembling a cap of the electric cooking appliance, to prevent a product from being damaged and lowering riskiness of safety hazard during installment of the cap. It is another object of the present disclosure to provide a structure for covering a connection line, an electric cooking appliance including the same, and a method of assembling a cap of the electric cooking appliance, to enhance safety and convenience of an operation of installing the cap.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

A structure covering a connection line may include a base plate including through a through hole in a vertical direction, a cap provided below the base plate and provided with an accommodation space formed therein to accommodate a connection line placed through the through hole from an upper portion of the base plate, a coupling boss extending in a vertical direction in the cap and coupled to bottom of the base plate to couple the cap to the base plate, and a fastener inserted through the base plate from the upper portion of the base plate to couple the base plate to the coupling boss. A first coupling hole may be formed in the base plate in a vertical direction, a second coupling hole may be open upward in the coupling boss, and the cap may be installed at a portion in which the first coupling hole and the second coupling hole overlap each other in a vertical direction.

The base plate may include a fit wall formed by bending a surrounding portion of the first coupling hole in an upward direction, and the coupling boss may be fit-coupled to the fit wall through the first coupling hole. The fit wall may taper upward such that a diameter of the first coupling hole is reduced.

The structure may further include a hook provided at the cap, inserted through the base plate via the through hole, and contacting an inner circumferential surface of the through hole, wherein a position of the cap coupled to the base plate may be guided in a right and left direction via contact between the hook and the inner circumferential surface of the through hole at a first side of the cap and fit-coupling between the coupling boss and the fit wall at a second side of the cap. The structure may further include a guide rib provided at the cap, inserted through the base plate via the through hole, and contacting an inner circumferential surface of the through hole, wherein a position of the cap coupled to the base plate may be guided in a forward and backward direction via fit-coupling between the coupling boss and the fit wall and contact between the guide rib and an inner circumferential surface of the through hole.

The fastener may include a screw configured in such a way that a body is inserted into the first coupling hole and the second coupling hole from the upper portion of the base plate and screwed to the coupling boss and a head is supported by the upper portion of the base plate. The structure may further include a hook provided at the cap, inserted through the base plate via the through hole, and having an upper end portion that is placed through the base plate and contacts an upper surface of the base plate to restrict downward movement of the cap. The cap may include a bottom surface spaced apart from the base plate by a predetermined interval and a lateral wall extending from the bottom surface in a vertical direction, and an upper end portion of at least a portion of the lateral wall may interfere with a lower surface of the base plate to restrict upward movement of the cap.

An electric cooking appliance may include a cavity including a cooking chamber and a machine room formed therein, a base plate with a through hole formed therethrough in a vertical direction, a cap provided below the base plate and having an accommodation space formed therein to accommodate a connection line placed through the through hole from an upper portion of the base plate, a first hook provided at a first side of the cap, inserted through the base plate via the through hole, and hook-coupled to the base plate to couple the one side of the cap to the base plate, and a second hook provided at a second side of the cap, inserted through the base plate at a different position from the first hook, and hook-coupled to the base plate to couple the other side of the cap to the base plate.

An electric cooking appliance may include a cavity including a cooking chamber and a machine room formed therein, a door rotatably coupled to the cavity and configured to open and close the cooking chamber, a base plate provided below the cavity and including a through hole formed therethrough in a vertical direction, a connection line extending out of the cavity through the through hole from the machine room and connected to an internal portion of the door, a cap provided below the base plate and having an accommodation space formed therein to accommodate a portion of the connection line, which extends out of the cavity, a coupling boss extending in a vertical direction at the cap and coupled to the base plate below the base plate, and a fastener inserted through the base plate from the upper portion of the base plate to couple the base plate and the coupling boss. The electric cooking appliance may further include a control panel provided in the door, wherein the connection line may be connected to the control panel in the door.

A method of assembling a cap of the electric cooking appliance may include rotatably coupling the door in front of the cavity and coupling the base plate below the cavity, placing a connection line through the through hole and electrically connecting an internal portion of the machine room and an internal portion of the door through the connection line, placing a cap below the base plate so as to accommodate a portion of the connection line, which extends out of the cavity, and placing a fastener through the base plate from an upper portion of the base plate and coupling the base plate and the coupling boss. The placing of the cap below the base plate may include inserting a hook provided at the cap into the through hole such that the hook contacts an inner circumferential surface of the through hole and fit-coupling the coupling boss to a fit wall provided at the base plate.

A structure for covering a connection line, an electric cooking appliance including the same, and a method of assembling a cap of the electric appliance are described with regard to exemplary embodiments of the invention with reference to the attached drawings. For convenience of description, the thicknesses of lines and the size of components in the drawings are exaggerated for clarity. The terms used in the specification are defined in consideration of functions used in the present disclosure, and can be changed according to intent or conventionally used methods of clients, operators, and users. Accordingly, definitions of the terms should be understood on the basis of the entire description of the present specification.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric cooking appliance, comprising:

a cavity including a cooking chamber and a machine room formed therein;

a base plate provided below the cavity and including a through hole in a vertical direction;

a cap provided below the base plate and provided with an accommodation space formed therein to accommodate a connection line placed through the through hole from an upper portion of the base plate;

a coupling boss extending in a vertical direction in the cap and coupled to bottom of the base plate to couple the cap to the base plate; and a fastener confirmed to be inserted through the base plate from the upper portion of the base plate to couple the base plate to the coupling boss, wherein a first coupling hole is formed in the base plate in the vertical direction;

a second coupling hole is open upward in the coupling boss; and the cap is installed at a portion in which the first coupling hole and the second coupling hole overlap each other in the vertical direction, and wherein the base plate includes a fit wall formed by bending a surrounding portion of the first coupling hole in an upward direction; and the coupling boss is fit-coupled to the fit wall through the first coupling hole.

2. The electric cooking appliance according to claim 1, wherein the fit wall tapers upward such that a diameter of the first coupling hole is reduced.

3. The electric cooking appliance according to claim 1, further including a hook provided at the cap, inserted through the base plate via the through hole, and contacting an inner circumferential surface of the through hole, wherein a position of the cap coupled to the base plate is fixed in a right and left direction via contact between the hook and the inner circumferential surface of the through hole at a first side of the cap and fit-coupling between the coupling boss and the fit wall at a second side of the cap.

4. The cooking appliance according to claim 1, further including a guide rib provided at the cap, inserted through the base plate via the through hole, and contacting an inner circumferential surface of the through hole, wherein a position of the cap coupled to the base plate is fixed in a forward and backward direction via fit-coupling between the coupling boss and the fit wall and contact between the guide rib and an inner circumferential surface of the through hole.

5. The electric cooking appliance according to claim 1, wherein the fastener includes a screw configured in such a way that a body is inserted into the first coupling hole and the second coupling hole from the upper portion of the base plate and screwed to the coupling boss and a head is supported by the upper portion of the base plate.

6. The electric cooking appliance according to claim 1, further including a hook provided at the cap, inserted through the base plate via the through hole, and having an upper end portion that is placed through the base plate and contacts an upper surface of the base plate to restrict downward movement of the cap.

7. The electric cooking appliance according to claim 1, wherein:

the cap includes a bottom surface spaced apart from the base plate by a predetermined distance and a lateral wall extending from the bottom surface in a vertical direction; and an upper end of at least a portion of the lateral wall contacts a lower surface of the base plate to restrict upward movement of the cap.

8. The electric cooking appliance according to claim 1, further including a hook provided at the cap and inserted through the base plate via the through hole, wherein:

the cap includes a bottom surface spaced apart from the base plate by a predetermined distance and a lateral wall extending from the bottom surface in a vertical direction;

the hook has an upper end portion that is inserted through the base plate and contacts an upper surface of the base plate to restrict downward movement of the cap; and an upper end of at least a portion of the lateral wall contacts a lower surface of the base plate to restrict upward movement of the cap.

* * * * *